US009578698B2

(12) United States Patent
Chien

(10) Patent No.: US 9,578,698 B2
(45) Date of Patent: Feb. 21, 2017

(54) LIGHT EMITTED DIODE CIRCUIT

(71) Applicants: Chen-Feng Chien, New Taipei (TW); Jing-Ru Chen, New Taipei (TW)

(72) Inventor: Chen-Feng Chien, New Taipei (TW)

(73) Assignees: CHEN-FENG CHIEN, New Taipei (TW); Jing-Ru Chen, New Taipei (TW)

( * ) Notice: Subject to any disclaimer, the term of this patent is extended or adjusted under 35 U.S.C. 154(b) by 52 days.

(21) Appl. No.: 14/690,489

(22) Filed: Apr. 20, 2015

(65) Prior Publication Data

US 2016/0174306 A1 Jun. 16, 2016

Related U.S. Application Data

(60) Provisional application No. 62/090,889, filed on Dec. 12, 2014.

(30) Foreign Application Priority Data

Feb. 10, 2015 (TW) ..... 104104438 A

(51) Int. Cl.
*H05B 33/08* (2006.01)

(52) U.S. Cl.
CPC ..... *H05B 33/0809* (2013.01); *H05B 33/0827* (2013.01)

(58) Field of Classification Search
CPC ..... H05B 33/0809; H05B 33/0827
See application file for complete search history.

(56) References Cited

U.S. PATENT DOCUMENTS 4,651,061 A * 3/1987 Spissinger ..... H05B 39/02 315/171
2007/0115661 A1* 5/2007 Kato ..... H05B 33/0821 362/249.12
2012/0069560 A1* 3/2012 Miskin ..... H05B 33/0821 362/227
2012/0217902 A1* 8/2012 Yang ..... H05B 33/0806 315/314
2012/0293083 A1* 11/2012 Miskin ..... H05B 33/0809 315/192
2013/0051001 A1* 2/2013 Miskin ..... H05B 33/0806 362/227
2013/0063043 A1* 3/2013 Daniel ..... H05B 33/0809 315/294
2014/0292213 A1* 10/2014 Yoon ..... H05B 33/0821 315/192

* cited by examiner

*Primary Examiner* — Douglas W Owens
*Assistant Examiner* — Pedro C Fernandez
(74) *Attorney, Agent, or Firm* — Winston Hsu; Scott Margo

(57) ABSTRACT

A light emitted diode circuit includes: a plurality of driving circuits, wherein the plurality of driving circuit are connected in series, and each driving circuit includes a plurality of diodes; and a plurality of loading circuits connected with the driving circuits, respectively; wherein the plurality of driving circuits are arranged for generating a plurality of driving voltages to drive the plurality of loading circuits, respectively.

6 Claims, 4 Drawing Sheets

LIGHT EMITTED DIODE CIRCUIT

CROSS REFERENCE TO RELATED APPLICATIONS

This application claims the benefits of U.S. provisional application No. 62/090,889 (filed on 2014, Dec., 12). The entire contents of the related applications are incorporated herein by reference.

BACKGROUND OF THE INVENTION

1. Field of the Invention

The present invention relates to a diode circuit, and more particularly, to a light emitted diode (LED) circuit that can reduce power consumption effectively and generate less heat.

2. Description of the Prior Art

Generally, a LED circuit has higher temperature in operation which causes a bad effect to whole circuit, therefore, how to utilize a simple circuit architecture to reduce the generated heat when the LED circuit is operating is an important issue.

SUMMARY OF THE INVENTION

One of the objectives of the present invention is to provide an LED circuit whose power consumption and the generated heat can be reduced effectively.

According to an embodiment of the present invention, a LED circuit comprises: a plurality of driving circuits, wherein the plurality of driving circuits are connected in series, and each driving circuit comprises a plurality of diodes; a plurality of loading circuits, wherein each loading circuit connects to the corresponding driving circuit respectively; wherein the plurality of driving circuits are arranged for generating a plurality of driving voltages for driving the plurality of loading circuit respectively.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should not be interpreted as a close-ended term such as "consist of". Also, the term "couple" is intended to mean either an indirect or direct electrical connection. Accordingly, if one device is coupled to another device, that connection may be through a direct electrical connection, or through an indirect electrical connection via other devices and connections.

Figure 1:
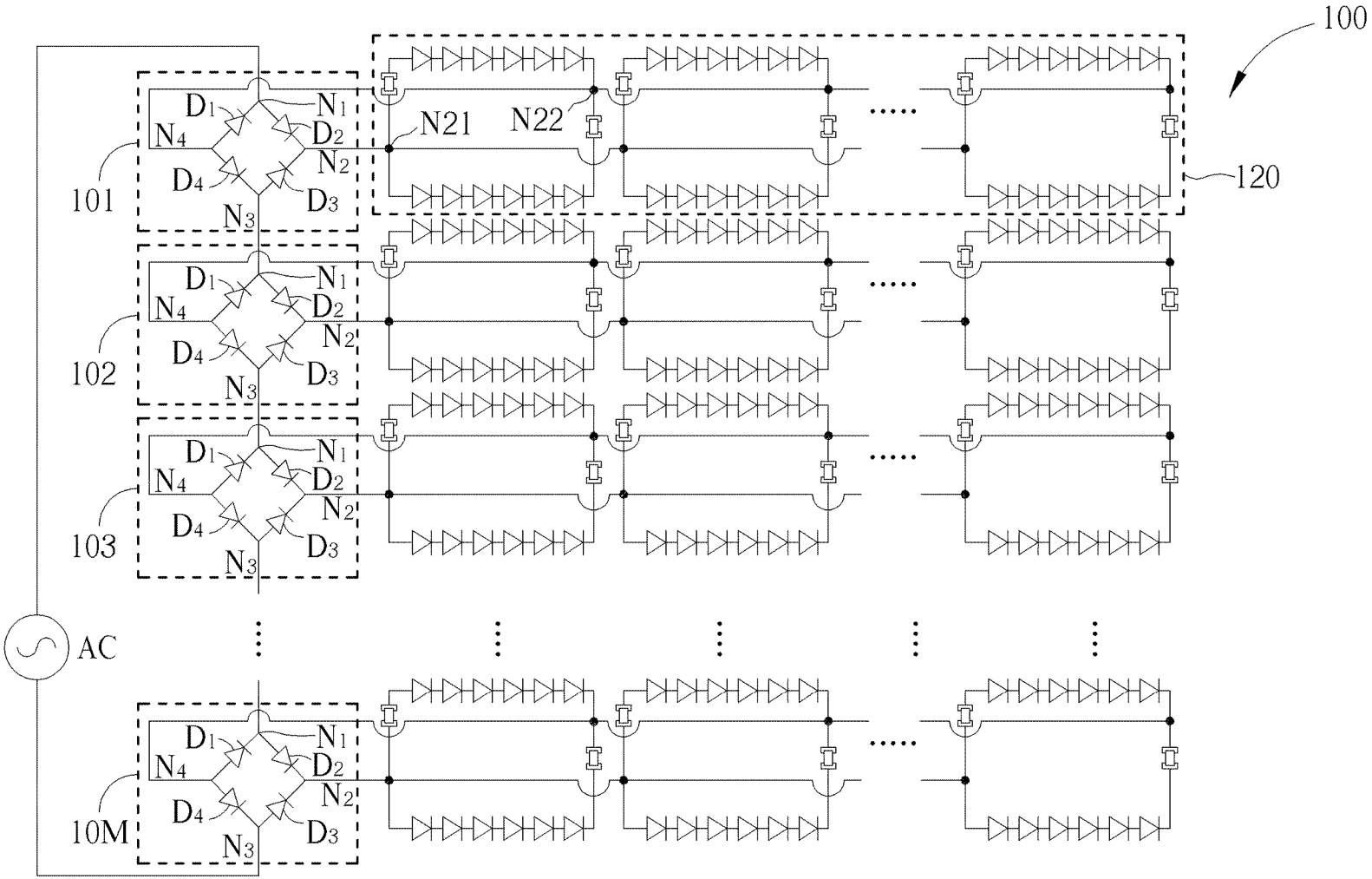
FIG. 1 is a diagram illustrating an LED circuit according to an embodiment of the present invention.
Figure 2:
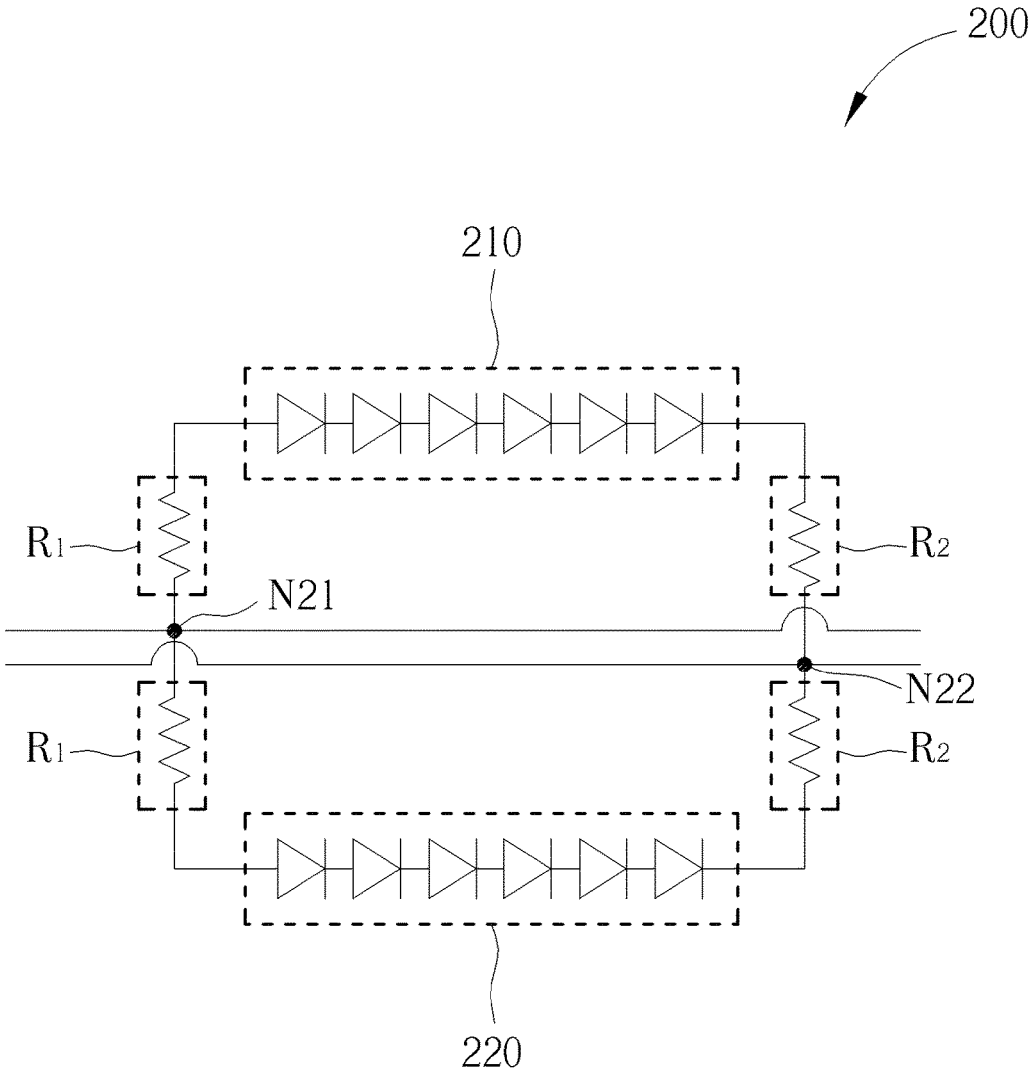
FIG. 2 is a diagram illustrating a loading block according to an embodiment of the present invention.

FIG. 1 is a diagram illustrating an LED circuit 100 according to an embodiment of the present invention. As shown in FIG. 1, the LED circuit 100 comprises a plurality of driving circuits 101 to 10M connected in series and a plurality of loading circuits, wherein each driving circuit connects to the corresponding loading circuit 120, and each driving circuit comprises diodes D1, D2, D3 and D4 and nodes N1, N2, N3 and N4. As shown in FIG. 1, the diodes D1, D2, D3 and D4 constitute a pattern like a bridge circuit. More specifically, take driving circuit 101 as an example, an N terminal of the diode D1 and a P terminal of the diode D2 connect to a node N1 included within the driving circuit 101, an N terminal of the diode D2 and an N terminal of the diode D3 connect to a node N2 included within the driving circuit 101, a P terminal of the diode D3 and an N terminal of the diode D4 connect to a node N3 included within the driving circuit 101, and a P terminal of the diode D4 and a P terminal of the diode D1 connect to a node N4 included within the driving circuit 101. In addition, the node N1 of the driving circuit 101 connects to a terminal of an alternating current (AC) source, and a node N3 of the driving circuit 10M connects to the other terminal of the AC source, besides, the node N1 of each driving circuit (except the driving circuit 101) is connected to the node N3 of the previous driving circuit as shown in FIG. 1. And each loading circuit comprises at least a loading block connected in parallel. In this embodiment, more than one loading block employed here as shown in FIG. 1, wherein the at least a loading block connected in parallel comprises a plurality of LEDs, and the plurality of LEDs can be equally divided into a plurality of LED strings connected in parallel, and the LEDs included within each LED string are connected in series. Refer to FIG. 1 and FIG. 2, FIG. 2 is a diagram illustrating a loading block 200 according to an embodiment of the present invention. In FIG. 2, a plurality of LEDs in the loading block 200 are equally divided into two LED strings (i.e. the LED strings 210 and 220), but it's only for illustration, not a limitation of the present invention, in other embodiments, the plurality of LEDs can be divided into three or more LED strings. As shown in FIG. 2, P terminals of the first LEDs of the LED strings 210 and 220 couple to a node N21, and N terminals of the last LEDs of the LED strings 210 and 220 couple to a node N22, and the nodes N21 and N22 are coupled to the nodes N2 and N4 of the corresponding driving circuit respectively, and each loading block further comprises two resistances, i.e. the resistors R1 and R2 whose resistances are very low, and the resistor R1 may be coupled between the first LEDs of the LED strings 210 and 220, and the resistor R2 may be coupled between the last LEDs of the LED strings 210 and 220.

Figure 3:
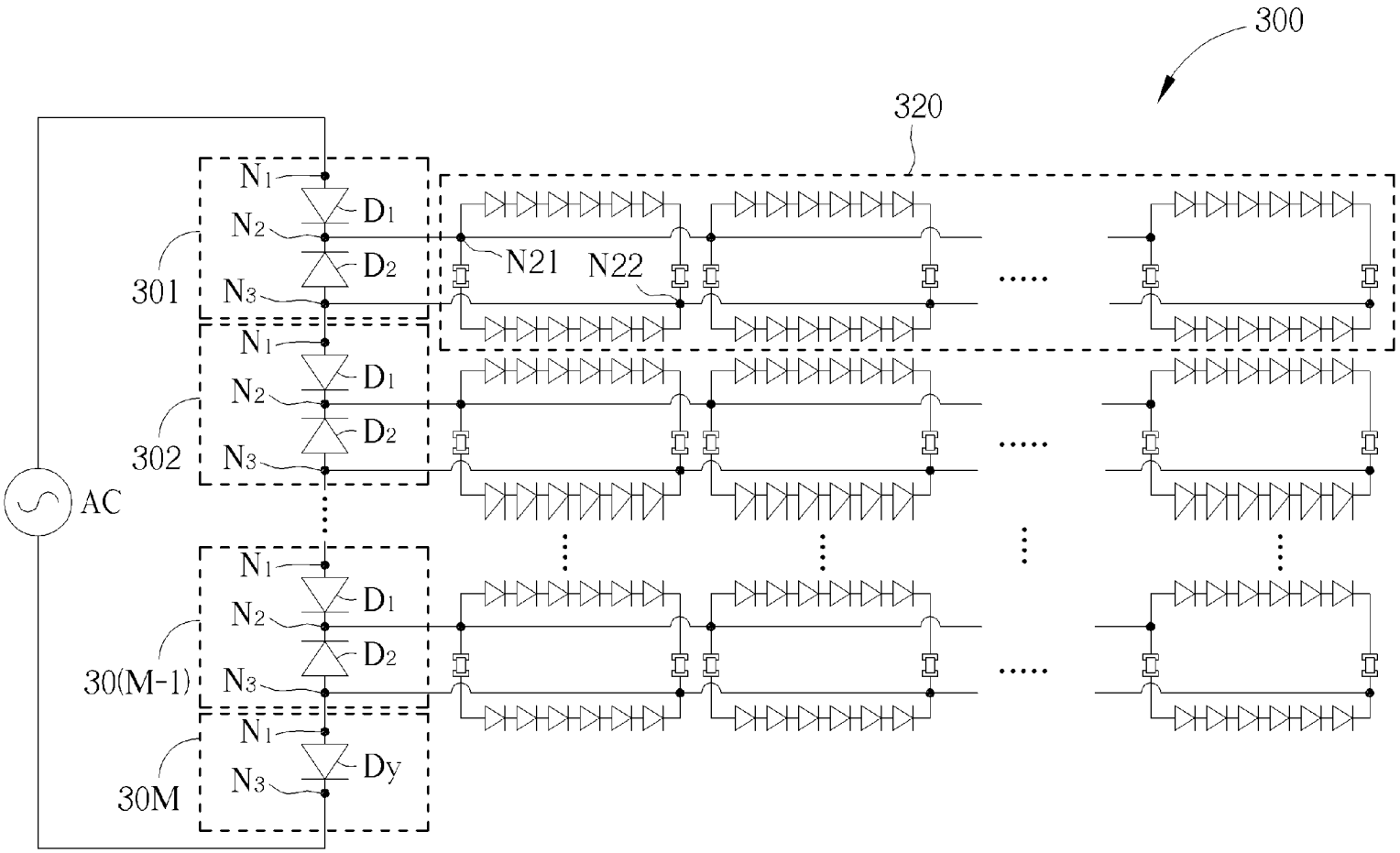
FIG. 3 is a diagram illustrating an LED circuit according to another embodiment of the present invention.

FIG. 3 is a diagram illustrating an LED circuit 300 according to another embodiment of the present invention. The LED circuit 300 comprises a plurality of driving circuits 301 to 30M connected in series and a plurality of loading circuits, wherein each of the driving circuits 301 to 30(M−1) is coupled to a corresponding loading circuit, e.g. the driving circuit 301 is coupled to the loading circuit 320. The plurality of loading circuits in FIG. 3 are identical with the plurality of loading circuits shown in the embodiments of FIG. 1 and FIG. 2, the detailed description is thus omitted here. In this embodiment, the driving circuits 301 and 30(M−1) comprises diodes D1 and D2 and nodes N1, N2 and N3, wherein N terminals of the diodes D1 and D2 of the driving circuits 302 to 30(M−1) are connected to the node N2, and a P terminal of the diode D1 is connected to the node N1, a P terminal of the diode D2 is connected to the node N3. In addition, the node N1 of the driving circuit 301 is coupled to a terminal of an AC source via the node N1. And the driving circuit 30M comprises a diode $D_y$ and nodes N1 and N3, wherein a P terminal of the diode $D_y$ is connected to the node N1, an N terminal of the diode $D_y$ is coupled to the other terminal of the AC source via the node N3. And, the nodes N1 of the driving circuits 302 to 30M are connected to the node N3 of the previous driving circuit as shown in FIG. 3. Refer to FIG. 2 and FIG. 3, the nodes N2 and N3 of the driving circuits 302 to 30(M−1) are coupled to the nodes N21 and N22 of the at least a loading block of the corresponding loading circuit respectively.

Figure 4:
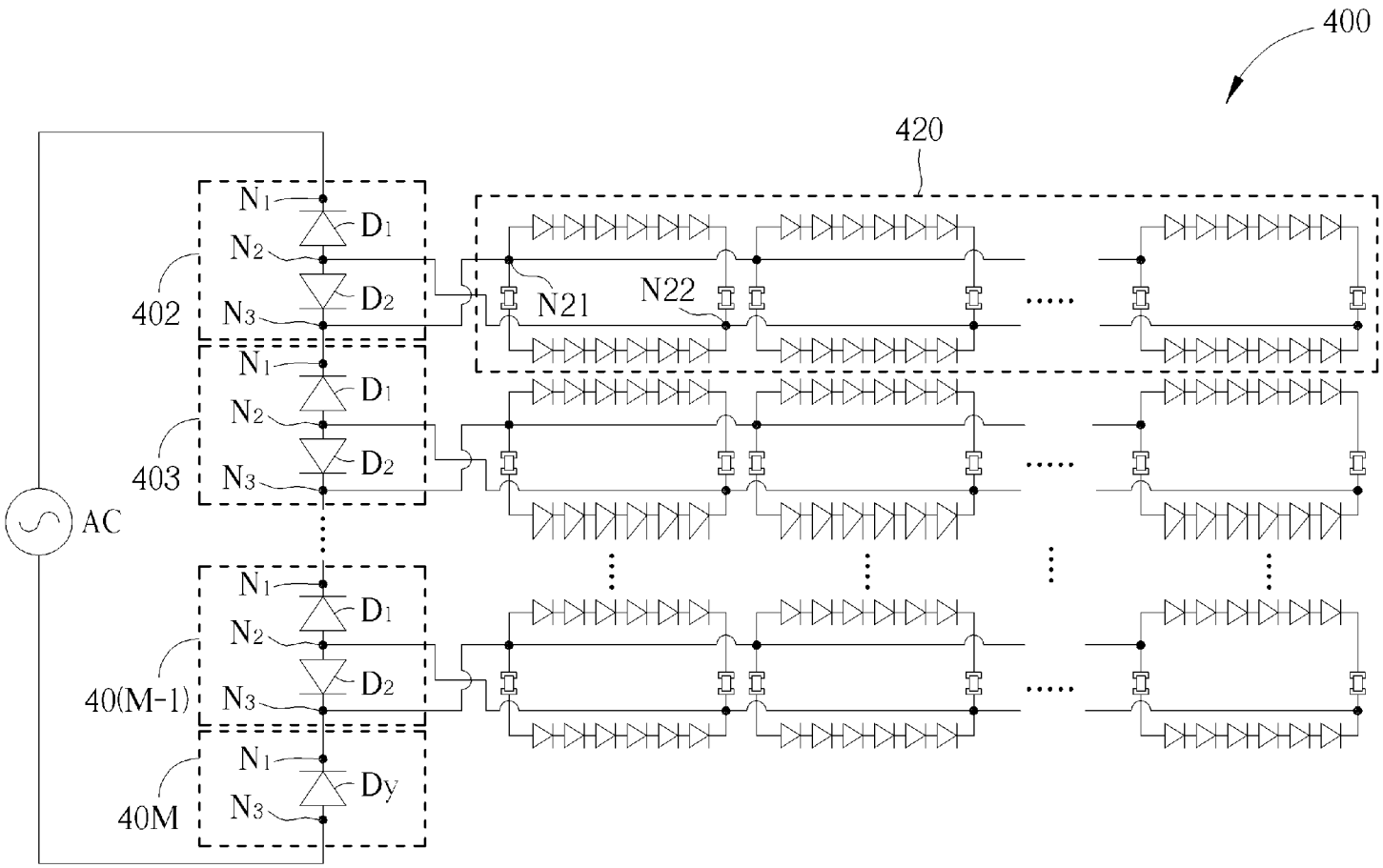
FIG. 4 is a diagram illustrating an LED circuit according to yet another embodiment of the present invention.

FIG. 4 is a diagram illustrating an LED circuit 400 according to yet another embodiment of the present invention. The LED circuit 400 comprises a plurality of driving circuits 401 to 40M connected in series and a plurality of loading circuits, wherein each of the driving circuits 401 to 40 (M−1) is coupled to a corresponding loading circuit, e.g. the driving circuit 401 is coupled to the loading circuit 420. And the plurality of loading circuits are identical with the plurality of loading circuits shown in the embodiments of FIG. 1 and FIG. 2, the detailed description is thus omitted here. In this embodiment, the driving circuits 401 and 40(M−1) comprises diodes D1 and D2 and nodes N1, N2 and N3, wherein P terminals of the diodes D1 and D2 of the driving circuits 401 to 40(M−1) are connected to the node N2, and an N terminal of the diode D1 is connected to the node N1, an N terminal of the diode D2 is connected to the node N3. In addition, the node N1 of the driving circuit 401 is coupled to an AC source via the node N1. And the driving circuit 40M comprises a diode $D_y$ and nodes N1 and N3, wherein a P terminal of the diode $D_y$ is coupled to the other terminal of the AC source via the node N1, and an N terminal of the diode $D_y$ is connected to the node N1. And, the nodes N1 of the driving circuits 402 to 40M are connected to the node N3 of the previous driving circuit. Refer to FIG. 2 and FIG. 4, the nodes N2 and N3 of the driving circuits 402 to 40 (M−1) are coupled to the nodes N22 and N21 of the at least a loading block of the corresponding loading circuit respectively.

In the embodiments of FIG. 1 to FIG. 4, the AC sources are the power source from electric outlet, but this is not a limitation of the present invention. Besides, the quantity of the driving circuit, loading block, the LED string, the LED included in a LED string is variable according to the used AC source as long as the impedance matching of all loadings can reach the max power efficiency.

With the assistance of optical lab of Taiwan SGS Co., Ltd, the experiment condition is: environment temperature 25 Celsius degrees, humidity 60±20%, input AC source 110V 60 Hz, loading 504 LEDs, (in the present invention, there are seven driving circuits and corresponding loading circuit, each loading circuit comprises six loading blocks, each loading block comprises two Led strings, each LED string comprises six LEDs). With this condition, the measured result of the present invention is power consumption 15.66 Watt, the power factor 0.8013, and the consumed energy is 0.01566 kwHr which shows the present invention can reduce the power consumption and the generated heat.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitted diode (LED) circuit, comprising:

a plurality of driving circuits, wherein the plurality of driving circuit are connected in series, and each driving circuit comprises a plurality of diodes;

a plurality of loading circuits, connected to the corresponding driving circuit respectively;

wherein the plurality of driving circuit are arranged for generating a plurality of driving voltages respectively to drive the plurality of loading circuits;

wherein each loading circuit comprises at least a loading block, and the at least a loading block comprises a plurality of loading strings, a first node and a second node, and each loading string comprises a plurality of diodes connected in series, and a P terminal of a first diode of the plurality of diodes connected in series is coupled to the first node, an N terminal of a last diode of the plurality of diodes connected in series is coupled to the second node;

wherein the plurality of diodes in each driving circuit comprise a first diode, a second diode, a third diode and a fourth diode, and each driving circuit further comprises a first node, a second node, a third node and a fourth node, wherein an N terminal of the first diode and a P terminal of the second diode are connected to the first node of the driving circuit, an N terminal of the second diode and an N terminal of the third diode are connected to the second node of the driving circuit, a P terminal of the third diode and an N terminal of the fourth diode are connected to the third node of the driving circuit, a P terminal of the fourth diode and a P terminal of the first diode are connected to the fourth node;

wherein the first node of a first driving circuit of the plurality of driving circuits connected in series is coupled to a terminal of an alternating current (AC) source, the third node of a last driving circuit of the plurality of driving circuits connected in series is coupled to the other terminal of the AC source; and except the first driving circuit of the plurality of driving circuits connected in series, the first nodes of other driving circuits are coupled to the third node of the previous driving circuit.

2. The LED circuit of claim 1, wherein the fourth node of each driving circuit is connected to the second node of the at least a loading block of the corresponding loading circuit, and the second node of each driving circuit is connected to the first node of the at least a loading block of the corresponding loading circuit.

3. The LED circuit of claim 1, wherein the at least a loading block further comprises two resistance elements, wherein one of the two resistance elements is coupled between the P terminals of the first diodes of two adjacent loading strings, and the other one is coupled between the N terminals of the last diodes of the two adjacent loading strings.

4. The LED circuit of claim 1, wherein the plurality of loading strings are LED strings.

5. A light emitted diode (LED) circuit, comprising:

a plurality of driving circuits, wherein the plurality of driving circuit are connected in series, and each driving circuit comprises a plurality of diodes;

a plurality of loading circuits, connected to the corresponding driving circuit respectively;

wherein the plurality of driving circuit are arranged for generating a plurality of driving voltages respectively to drive the plurality of loading circuits;

wherein each loading circuit comprises at least a loading block, and the at least a loading block comprises a plurality of loading strings, a first node and a second node, and each loading string comprises a plurality of diodes connected in series, and a P terminal of a first diode of the plurality of diodes connected in series is coupled to the first node, an N terminal of a last diode of the plurality of diodes connected in series is coupled to the second node;

wherein the driving circuits, except a last driving circuit of the plurality of driving circuits connected in series, comprise a first diode, a second diode, a first node, a second node and a third node, wherein N terminals of the first diode and the second diode or P terminals of the first diode and the second diode are connected to the second node, and the other terminal of the first diode and the other terminal of the second diode are coupled to the first node of driving circuit and the third node of driving circuit respectively; wherein the last driving circuit of the plurality of driving circuits connected in series comprises a diode, a first terminal and a second terminal, and if the N terminal of the first diode and the N terminal of the second diode of each driving circuit except the last driving circuit of the plurality of driving circuits connected in series are connected to the second node, an N terminal of the diode of the last driving circuit of the plurality of driving circuits connected in series is connected to the second terminal of the last driving circuit and a P terminal of the diode of the last driving circuit of the plurality of driving circuits connected in series is connected to the first terminal of the last driving circuit if the P terminal of the first diode and the P terminal of the second diode of each driving circuit except the last driving circuit of the plurality of driving circuits connected in series are connected to the second node, then a P terminal of the diode of the last driving circuit of the plurality of driving circuits connected in series is connected to the second terminal of the last driving circuit and a N terminal of the diode of the last driving circuit of the plurality of driving circuits connected in series is connected to the first terminal of the last driving circuit.

6. The LED circuit of claim 5, wherein the first terminal of the first driving circuit of the plurality of driving circuit connected in series is coupled to a terminal of an AC source, the second terminal of the last driving circuit of the plurality of driving circuit connected in series is coupled to the other terminal of the AC source, and the first node of each driving circuit except the first driving circuit of the plurality of driving circuits connected in series is connected to the third node of the previous driving circuit; except the last driving circuit of the plurality of driving circuits connected in series, the N terminal of the second diode of each driving circuit is coupled to the first node of the at least a loading block of the corresponding loading circuit, and the P terminal of the second diode of each driving circuit is coupled to the second node of the at least a loading block of the corresponding loading circuit.

* * * * *